US009995079B2

(12) United States Patent
Fumanelli

(10) Patent No.: US 9,995,079 B2
(45) Date of Patent: Jun. 12, 2018

(54) SECURITY DEVICE FOR BANKNOTE CONTAINERS IN PARTICULAR FOR BANCOMAT, ATM, ACCEPTORS OR THE LIKE

(71) Applicant: M.I.B. S.r.L., Milan (IT)

(72) Inventor: Giuseppe Ezio Fumanelli, Melzo (IT)

(73) Assignee: M.I.B. S.R.L., Milan (IT)

( * ) Notice: Subject to any disclaimer, the term of this patent is extended or adjusted under 35 U.S.C. 154(b) by 0 days. days.

(21) Appl. No.: 14/865,878

(22) Filed: Sep. 25, 2015

(65) Prior Publication Data

US 2017/0089119 A1 Mar. 30, 2017

(51) Int. Cl.

| | |
|---|---|
| ***E05G 1/14*** | (2006.01) |
| ***E05G 1/12*** | (2006.01) |
| ***E05G 1/02*** | (2006.01) |
| ***G07F 19/00*** | (2006.01) |

(52) U.S. Cl.

CPC ..... *E05G 1/14* (2013.01); *E05G 1/02* (2013.01); *E05G 1/12* (2013.01); *G07F 19/205* (2013.01); *E05G 2700/00* (2013.01); *E05G 2700/04* (2013.01)

(58) Field of Classification Search

CPC .... E05G 1/00; E05G 1/10; E05G 1/12; E05G 1/14; E05G 2700/00; E05G 1/02; E05G 1/04

See application file for complete search history.

(56) References Cited

U.S. PATENT DOCUMENTS

| | | | | |
|---|---|---|---|---|
| 2,117,244 A * | 5/1938 | Goehring | E05G 1/00 | 454/195 |
| 3,730,111 A * | 5/1973 | Matthews | E05G 1/14 | 109/24 |
| 3,871,281 A * | 3/1975 | Leonard | E05G 1/14 | 109/29 |
| 5,598,793 A * | 2/1997 | Lopez, Jr. | E05G 1/14 | 109/25 |
| 6,087,935 A * | 7/2000 | Berner | E05G 1/12 | 102/334 |
| 6,568,336 B2 * | 5/2003 | Van Lint | E05G 1/14 | 109/25 |
| 7,201,312 B2 * | 4/2007 | Fumanelli | E05G 1/14 | 109/25 |

(Continued)

FOREIGN PATENT DOCUMENTS

| | | |
|---|---|---|
| DE | 20 2006 004 439 U1 | 5/2006 |
| DE | 10 2009 055 872 A1 | 6/2011 |

(Continued)

OTHER PUBLICATIONS

European Search Report for corresponding EP Application No. 14 17 0026, two pages, completed Oct. 2, 2014.

*Primary Examiner* — Christopher J Boswell
(74) *Attorney, Agent, or Firm* — Vorys, Sater, Seymour and Pease LLP; Ari G. Zytcer

(57) ABSTRACT

Provided is a security device and method for preventing burglary of a container. The method includes igniting, via ignition means, an explosive substance in the container, so that the explosive substance is combusted before it reaches a critical mass. The method further includes conveying atmosphere from inside the container to the ignition means.

13 Claims, 1 Drawing Sheet

(56) References Cited

U.S. PATENT DOCUMENTS

| | | | | |
|---|---|---|---|---|
| 7,395,766 | B2 * | 7/2008 | Landwehr | E05G 1/005 109/25 |
| 8,939,358 | B2 * | 1/2015 | Cardinal | E05G 1/00 235/379 |
| 9,879,962 | B2 * | 1/2018 | Ueda | F42B 33/06 |

FOREIGN PATENT DOCUMENTS

| | | | |
|---|---|---|---|
| DE | 20 2014 101 209 | U1 | 3/2014 |
| EP | 1 865 141 | A2 | 12/2007 |
| WO | 2011/106844 | A1 | 9/2011 |

* cited by examiner

SECURITY DEVICE FOR BANKNOTE CONTAINERS IN PARTICULAR FOR BANCOMAT, ATM, ACCEPTORS OR THE LIKE

FIELD OF THE INVENTION

The present invention relates to an anti-burglar or security device for banknote containers in particular for Bancomat, ATM, acceptors or the like comprising: ignition means designed to ignite any explosive substances, inserted in the container, so that said explosives are combusted before they reach a critical mass, and conveying means suitable to convey the atmosphere contained inside said container to said ignition means.

DESCRIPTION OF THE PRIOR ART

A similar device is disclosed in PCT application WO-A-2011/106844.

Distributors of banknotes or valuables are currently known of, such as in particular ATMs or systems suitable to contain banknotes.

They comprise a container consisting of a safe suitable to contain banknotes and valuables and control means suitable to issue or receive banknotes and valuables to an authorised user. The issue of banknotes and valuables takes place after the recognition of the user by means of a card or the like, and takes place through a dispenser slot, communicating with the interior of the safe and suitable, as said, to issue or receive banknotes or valuables from an external user.

The dispenser slots are therefore generally aimed at public areas accessible to users and have a slit or the like, through which the banknotes and valuables pass, even collected in bundles.

As known, a general problem concerning the protection of containers such as in particular Bancomat, ATMs and the like is how to prevent a breaking perpetrated by the insertion therein of explosive substances or products, such as gases, mixtures, liquids, powders, aerosols, etc.

These substances, once inserted, are made to explode so as to open the container from the inside.

To try to remedy this danger, active protection devices are already known of substantially able to prevent explosions and fires inside Bancomat, ATMs, safe deposit boxes and the like.

These active protection apparatuses may act in combination with devices making the banknotes non-utilisable—by means of a marking—and comprise systems capable of diluting hazardous fluids introduced and/or chemically inhibiting their action.

In particular, to combat the most frequent cases, namely attacks on ATMs perpetrated by introducing detonating gases through the minimal slots present therein for functional requirements, or through small holes made there and then, various apparatuses are used, some mechanical, which hinder the access of the detonating gases to the drawers or compartments containing the banknotes, others which in the presence of any hazardous mixtures detected automatically activate discharges of CO2 or aerosols suitable to inhibit the flames.

The Italian patent IT-B-1348079, in the name of the same applicant, further describes a system comprising the electrical ignition devices suitable to trigger the combustion of explosive substances before they reach a critical mass.

However, such systems do not completely resolve the drawbacks of the prior art. In this situation, the technical purpose according to the present invention is to devise a security device for banknote containers in particular for Bancomat, ATM, acceptors or the like able to substantially overcome the drawbacks mentioned.

SUMMARY OF THE INVENTION

Within the scope of said technical purpose one important objective of the invention to obtain a security device for banknote containers in particular for Bancomat, ATM, acceptors or the like which prevents the breaking of the container by the introduction of explosive substances therein.

The technical purpose and specified aims are achieved by a security device for banknote containers in particular for Bancomat, ATM, acceptors or the like comprising: ignition means designed to ignite any explosive substances, inserted in the container, so that said explosives are combusted before they reach a critical mass, conveying means suitable to convey the atmosphere contained inside said container to said ignition means, said ignition means and said conveying means being inside said container.

BRIEF DESCRIPTION OF THE DRAWINGS

The characteristics and advantages of the invention are clearly evident from the following detailed description of a preferred embodiment thereof, with reference to the accompanying drawings, in which.

Figure 1:
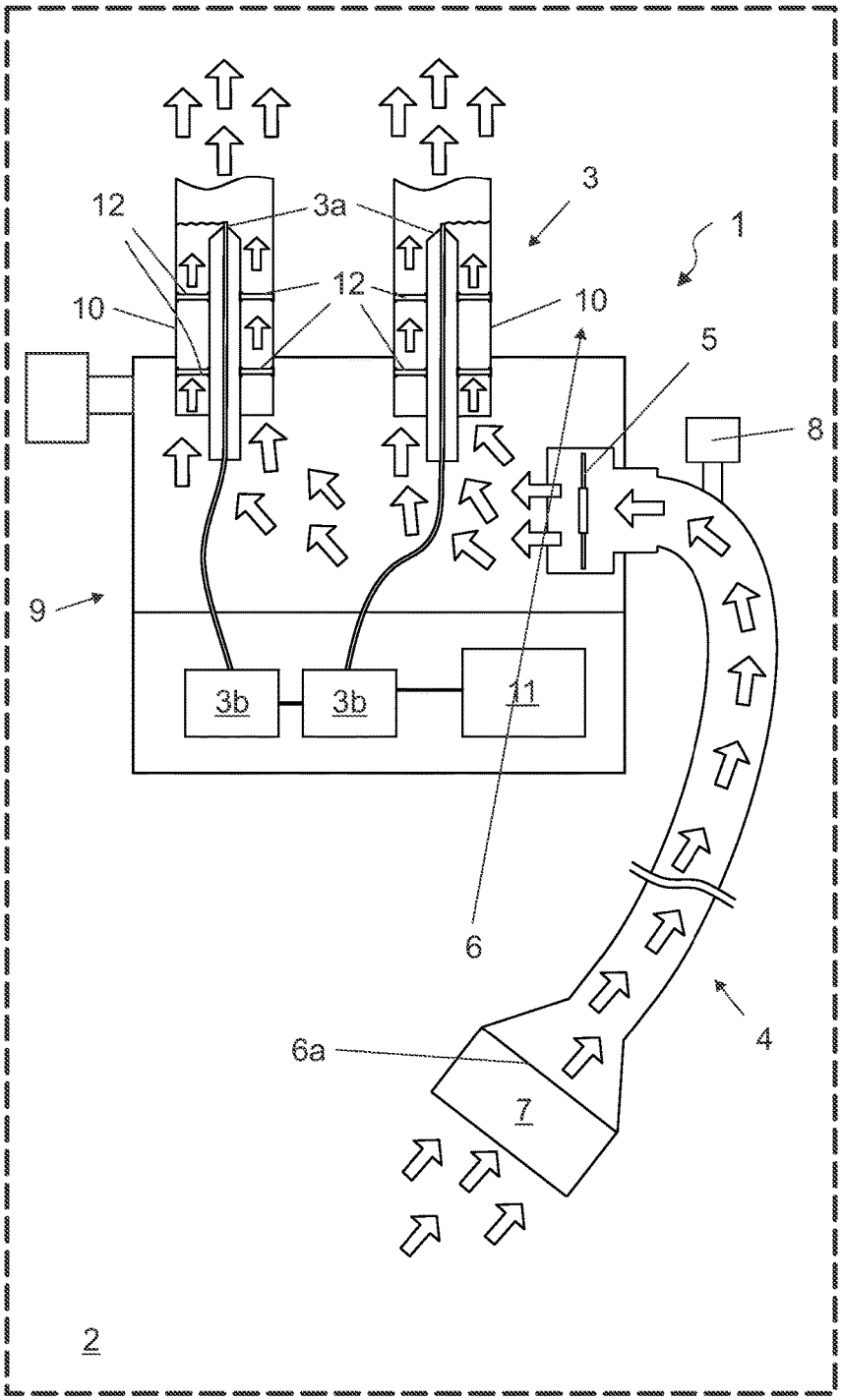
FIG. 1 shows a diagram of the device according to the invention.

With reference to said drawings, reference numeral 1 globally denotes the security device according to the invention.

DESCRIPTION OF THE PREFERRED EMBODIMENTS

It is positioned in correspondence with a container 2, such as a safe, in particular a safe for Bancomat, ATMs and the like, with the function of preventing breaking of the container 2 by insertion of substances or explosive products, such as gases, explosive vapours and also mixtures, liquids, etc.

The security device 1 comprises, in brief, ignition means 3 suitable to ignite any explosive substances inserted in the container 2, so that said explosive substances are combusted before they reach a critical mass suitable to cause an explosion, and conveying means 4 suitable to convey the atmosphere contained inside the container 2 to the ignition means 3.

Ignition means 3 and conveying means 4 are both inside the container 2.

The term atmosphere is understood to mean the air commonly present and also gases and vapours and/or other substances in suspension in said gases and vapours.

The conveying means 4 advantageously determine a flow of atmosphere with a flow rate which is not constant but varies over time. In particular, said flow rate shows a periodic trend, more in particular such flow rate varies in a continuous manner, without jumps or steps of a substantial variation, more in particular still, in a sinusoidal manner.

The conveying means 4 preferably comprise at least one suction device 5, such as a fan and the like, suitable to create a flow of atmosphere to be conveyed in a forced manner.

They further preferably include ducts 6, such as one or more tubes and/or channels in fluidic through connection with the suction device 5. Said ducts 6 comprise one or more openings 6*a* positioned inside the container 2 and suitable to withdraw said atmosphere from different points in appropriate positions of the container 2. Moreover, a filter 7, preferably a thickness or porous or other filter is appropriately positioned at the openings 6*a*. The latter is suitable to filter dust, of advantageous size and in relation to the surroundings.

Structurally the ducts 6 end in a box 9, isolated from the outside. The suction device 5 and also a pressure switch 8 and/or flow switch and/or flow meter are preferably positioned at or near the box 9, placed in correspondence with the ducts 6 and suitable to verify the possible reduction of flow and/or obstruction thereof.

The ignition means 3 suitable to ignite any explosive substances are preferably placed in correspondence with or near the box 9.

In particular, there are one or more outlet ducts 10 of the atmosphere from the box 9. More in particular, the ignition means 3 are placed in correspondence with the outlet ducts 10.

The ignition means 3 may be variously achieved, while still maintaining a very simple structure and a minimal cost. They are preferably electric ignition means. Alternatively, the ignition means 3 may consist of piezoelectric lighters, incandescent lighters or even pyrotechnic ignition means. The piezoelectric and electric ignition means act by means of sparks and therefore have a reduced noise, lower than that of pyrotechnic ignition means, which act via small explosions. Incandescent ignition means are instead absolutely silent for prolonged use over time.

The ignition means 3 comprise an ignition terminal 3*a*, suitable to achieve the ignition of the explosive substances, and in particular the electric arc, which closes appropriately on a wall of the outlet duct 10, and a power supply 3*b*, connected to the ignition portion 3*a* and preferably consisting of an electrical or power transformer or the like.

The ignition terminals 3*a* are supported and distanced from the walls of the outlet ducts 10 by support spacers 12 suitable to permit the transit of the atmosphere through the ducts 10.

The power supply 3*b* is also preferably positioned in correspondence with the box 9, as well as control electronics 11, suitable to control the various elements of the device 1 described.

In the vicinity of the container 2 additional safety means such as alarms 14, may also be present, suitable to be activated as a result of the ignition of explosive substances by the ignition terminals 3*a*. These alarms 14 may comprise light sensors, pressure or velocimetric pressure sensors next to the ignition portions 3*a* and/or other portion.

Additional flame inhibitor means or other similar devices may also be present.

The functioning of the security device 1 previously described in functional terms is as follows and defines a new security procedure.

The container 2, and in particular the Bancomat, ATM or the like, works normally without any alteration.

During normal operation, appropriately, the conveying means 4 continue to aspirate the atmosphere through the openings 6*a* and the filters 7 and convey it to the ignition means 3.

The aspiration is preferably carried out with said sinusoidal or even periodic or even continuous trend without changes in flow over time. The periods of variation may be between 1 s and 10 s.

The conveying means 4 are preferably on constantly, substantially 24 hours per day and 7 days per week.

Moreover, the conveying means 4 and/or the ignition means 3 are preferably not functionally connected or alarms.

The ignition means also function constantly, in particular intermittently, with preferred pulse or even continuous frequency.

Should an ill-intentioned person introduce explosive substances inside the container 2, such as in particular detonating gases or explosive mixtures, the same would be rapidly aspirated by the conveying means 4. Said suction occurs in fact in any point of the container 2, which normally works at a single pressure and in a single environment. In particular the suction takes place rapidly by means of ducts 6 positioned in a plurality of points of the container 2, and/or even a plurality of openings 6*a*.

The explosive substances are thus conveyed to the ignition means 3 which ignite them, causing a flame or a small detonation before the explosive substances reach critical quantities which would result in the rupture of the container 2 by explosion.

The ignition takes place in particular in the case in which the specific explosive substance reaches its correct stoichiometric ratio with oxygen or with other substances. The non-constant but variable functioning of the atmosphere flow rate causes such correct stoichiometric ratio to be reached in at least one point of the curve which periodically repeats itself.

In particular, the ignition takes place through the ignition portions and extends along the outlet ducts 10 which are preferably made of flame-resistant material. In this case, in addition, possible alarms for the police or so forth would activate.

If the openings 6 were clogged or obstructed for any reason, a pressure or flow sensor 8 would detect the change in pressure and would activate an alarm for failure and/or simply to indicate the need for preventive maintenance.

The invention achieves important advantages.

In fact, the security device 1 simply and quickly defuses explosive substances introduced. In particular said device does not wait for the explosive substances to arrive at the terminals 3*a* as a result of saturation or filling of the container 2, or by natural, non-forced convection phenomena, but by internal forced convection towards the terminals 3*a* through the conveying means 4. Said forced convection is necessary since the natural recirculation, or the insertion zones of the explosives, are not always predictable and measurable. In the absence of the conveying means 4 the explosive substances could thus accumulate in sufficient quantities to make the container 2 explode.

Furthermore, the solution of continuously varying the flow rate of the conveying means, acts so that each specific explosive substance can automatically find its correct specific stoichiometric ratio, permitting its ignition, during the variations of intensity.

Furthermore, the security device 1 is simple and economical.

Variations may be made to the invention without departing from the scope of the inventive concept expressed in the independent claims and in the relative technical equivalents. All details may be replaced with equivalent elements and the scope of the invention includes all other materials, shapes and dimensions.

The invention claimed is:

1. A security device for a banknote container in a safe, comprising:

an ignition means configured to ignite an explosive substance, inserted in the container, so that said explosive substance is combusted before it reaches a critical mass;

a conveying means configured to convey atmosphere contained inside said container to said ignition means, said ignition means and said conveying means being inside said container, said explosive substance being a non-oxidizing detonating gas.

2. The security device according claim 1, wherein said conveying of the atmosphere takes place at a non-constant flow rate which varies over time.

3. The security device according to claim 1, wherein said conveying of the atmosphere takes place at a flow rate which follows a continuous trend, without variations.

4. The security device according to claim 1, wherein said conveying means comprise ducts in fluidic through connection with at least one suction device and comprising at least one opening positioned inside said container and configured to withdraw the atmosphere from said container at different points, at different heights and positions.

5. The security device according to claim 4, wherein said conveying means further comprises a filter, placed in correspondence with one or more of said at least opening and configured to filter said atmosphere contained in the container.

6. The security device according to claim 5, wherein said ignition means and said conveying means are not functionally connected to any alarm.

7. A method for preventing burglary of an item in a banknote container in a safe, comprising:

igniting an ignition means configured to ignite an explosive substance in the container, so that said explosive substance is combusted before it reaches a critical mass;

conveying atmosphere contained inside said container to said ignition means, so that said explosive substance is combusted before it reaches a critical mass, said ignition means and said conveying means working constantly and being not functionally connected to any alarm, said explosive substance being a non-oxidizing detonating gas.

8. The method according to claim 7, wherein said conveying of the atmosphere takes place at a non-constant flow rate which varies over time.

9. The method according to claim 7, wherein said conveying of the atmosphere takes place by means of a flow rate which follows a continuous trend, without variations.

10. The method according to claim 7, provided by means of a security device comprising a conveying means to convey the atmosphere contained inside said container to said ignition means.

11. The method according to claim 10, wherein said conveying means comprise at least one suction device configured to create a flow of air for conveying said atmosphere contained inside said container to said ignition means.

12. The method according to claim 11, wherein said conveying means further comprise ducts in fluidic through connection with said at least one suction device and comprising at least one opening positioned inside said container and configured to withdraw said atmosphere from said container at different points, at different heights and positions.

13. The method according to claim 12, wherein said conveying means further comprises a filter, placed in correspondence with one or more of said at least opening and configured to filter said atmosphere contained in the container.

* * * * *